US005601440A

United States Patent [19]

Richter

[11] Patent Number: 5,601,440

[45] Date of Patent: Feb. 11, 1997

[54] PLUG LOCK OUT APPARATUS

[76] Inventor: Julian Richter, 18780 N.E. 18th Ave., Unit #122, North Miami Beach, Fla. 33179

[21] Appl. No.: 600,701

[22] Filed: Feb. 13, 1996

[51] Int. Cl.[6] ..... H01R 13/44

[52] U.S. Cl. ..... 439/134; 439/133

[58] Field of Search ..... 439/133, 134, 439/367

[56] References Cited

U.S. PATENT DOCUMENTS 4,679,873 7/1987 Brackett, Jr. ..... 439/134 OR
5,052,939 10/1991 Koch ..... 439/133 OR
5,178,551 1/1993 Bach ..... 439/133 OR
5,186,636 2/1993 Boyer et al. ..... 439/133 OR

*Primary Examiner*—P. Austin Bradley
*Assistant Examiner*—Daniel Wittels

[57] ABSTRACT

The present electrical plug lock out apparatus comprises two matable, close-ended lids; a first female threaded lid and a second male threaded lid. Each lid has a flange or brim around the circumference of the lid which is integral with the lid. The flange or brim on each lid has an allignable hole for accepting a conventional pad lock or similar device. The male threaded lid has a plurality of elongated "U" shaped slots running through the threaded wall of the lid to a point approximately midway through the non-threaded wall of the lid. Each slot is sized to accept an electrical cord having a plug head.

7 Claims, 1 Drawing Sheet

PLUG LOCK OUT APPARATUS

FIELD OF THE INVENTION

This invention relates to an apparatus to facilitate the securing of electrical plugs. More specifically, the present invention discloses and teaches a two piece interlocking apparatus capable of securing a plurality of electrical plugs.

BACKGROUND OF THE INVENTION

With the advent of technology, many common devices require alternating electrical current as a power source. Such examples of devices include, but are not limited to, televisions, telephones, radios, facsimile machines, computers, and the like.

Recently, a problem has occurred with respect to underage, or otherwise inappropriate users, of these devices. The problem is the result of free-flowing information that may be viewed on the subject devices that might be considered inappropriate. For example, television, through network and cable programing, displays what some may consider to be material not suitable for all viewers.

In the case children, some, contrary to the instructions of their parents or other guardians, secretly view questionable material. This typically occurs when the parent or other guardian is out of viewing location (house). In order to police the children when a parent or other guardian is not around, a plethora of security devices have been devised to prevent the children from viewing material that is not suited for them. These devises range from internal scramblers to physical electrical plug lock out devices.

Some of the physical electrical plug lock out devices are exemplified by the following U.S. patents: U.S. Pat. No. 4,673,230 to Baumgart; U.S. Pat. No. 4,679,873 to Brackett, Jr.; U.S. Pat. No. 4,957,445 to Burke, Jr.; U.S. Pat. No. 5,073,122 to Burke, Jr.; and U.S. Pat. No. 5,186,636 to Boyer et al. While these references each teach and disclose that which they intend, they are not capable of securing a plurality of electrical plugs with a convenient threaded, two piece matable lock out apparatus.

SUMMARY OF THE INVENTION

The present electrical plug lock out apparatus comprises two matable, close-ended lids; a first female threaded lid and a second male threaded lid. Each lid has a flange or brim around the circumference of the lid which is integral with the lid. The flange or brim on each lid has an allignable hole for accepting a conventional pad lock or similar device. The male threaded lid has a plurality of elongated "U" shaped slots running through the threaded wall of the lid to a point approximately midway through the non-threaded wall of the lid. Each slot is sized to accept an electrical cord having a plug head. The cord may be similar to a television or computer cord, or may be similar to a telephone modular jack cord.

Once the cord or cords is inserted into each respective slot, the female lid is secured upon and mated to the male lid so that the flange holes allign with one another. Thereafter, a pad lock or similar device is applied to secure the two lids together. Each cord is prevented from being removed as each chord's plug head is too large to fit through the now-secured slots. Thus, the cord-plug head combination is secured.

It is thus an object of the present invention to provide an electrical plug lock out apparatus.

It is still another object of the present invention to provide an electrical plug lock out apparatus capable of housing a plurality of plug heads.

It is yet another object of the present invention to provide a simple-to-use two piece plug lock out apparatus that utilizes threadable members.

Other objects of the present invention will be readily understood in conjunction with the following written description.

BRIEF DESCRIPTION OF THE DRAWINGS

The features embodying the present invention are illustrated in the accompanying drawings, forming a part of this application, in which.

DETAILED DESCRIPTION OF A PREFERRED EMBODIMENT

Figure 1:
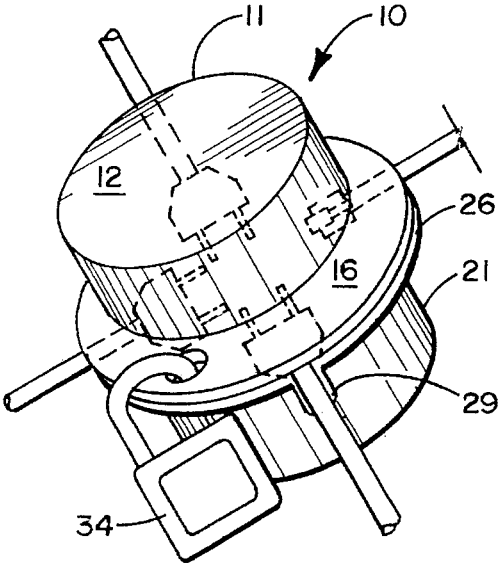
FIG. 1 is a perspective view of the present invention showing four (4) electrical plug lock out slots.
Figure 2:
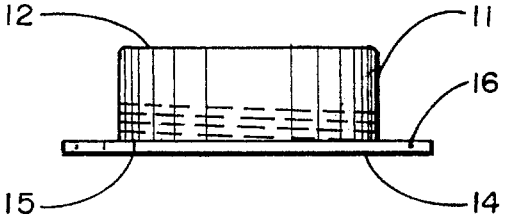
FIG. 2 is a side elevation of the female lid member of the present invention.
Figure 4:
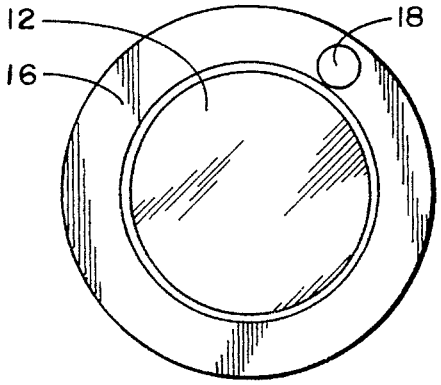
FIG. 4 is a top plan view of the inside of the female lid member of the present invention.
Figure 3:
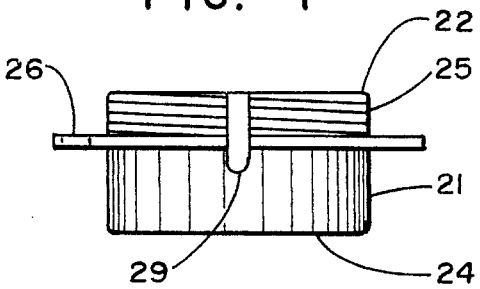
FIG. 3 is a side elevation of the male lid member of the present invention.

Referring now to FIGS. 1–5, the plug lock out apparatus 10 shown comprises of a first lid member 11 having a top 12 and a bottom 14. The plug lock out apparatus 10 is generally cylindrical in shape and may be constructed of any high strength plastic, such as ABS, or metal, or other suitable material.

The first lid member 11 has a female thread 15 on the inside thereof for matable engagement with the second lid member. The top 12 of first lid member 11 is close-ended. The bottom 14 of first lid member 11 is open-ended and comprises an annular ring flange 16. The annular ring flange 16 has a hole 18 therethrough for ultimate allignment with a hole on the flange of the second lid member, as further described below.

Figure 6:
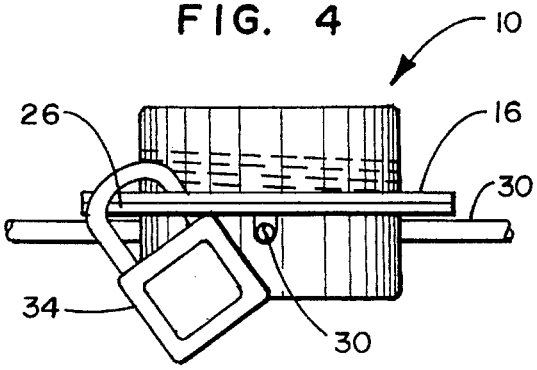
FIG. 6 is a side elevation view of the present invention showing a first type of cord secured; and, FIG. 7 is a side elevation view of the present invention showing an second type of cord secured.
Figure 5:
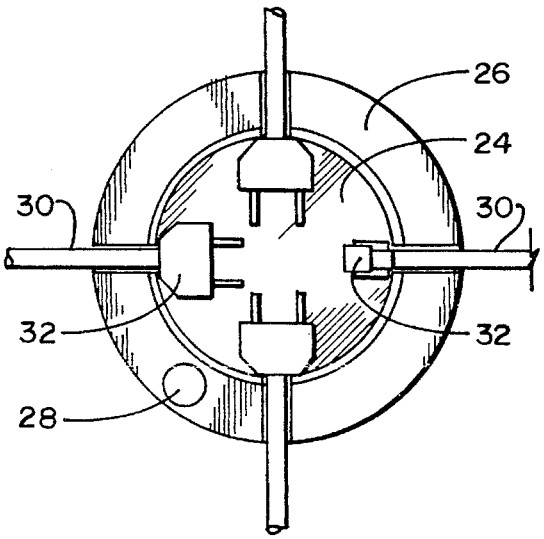
FIG. 5 is a top plan view of the inside of the male lid member of the present invention.
Figure 7:
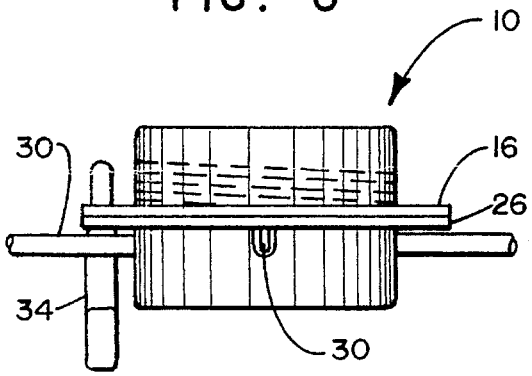

The second lid member 21 has an open-ended top 22 and close-ended bottom 24. The second lid member 21 has a male thread 25 on the top 22 thereof. The male thread 25 is disposed to the exterior of the second lid member 21 and is matably engagable with the female thread 15 of the first lid member 11. At the terminus of the male thread 25 on the second lid member 21, and to the exterior thereof, lies an annular ring flange 26. The ring flange 26 has a hole 28 thereon and is segregated by a plurality of elongated "U" shaped slots 29. In this preferred embodiment, four slots 29 are shown. Each slot 29 has a length longer than the combined length of the male thread 25 and the thickness of the ring flange 26. Each slot 29 may be of varying width to house an electrical cord 30 of varying thickness having a plug head 32 (See FIGS. 6 and 7).

In operation, to secure an electrical cord 30 and corresponding plug head 32, a cord or cords 30 is fitted within the slot 29 of the second lid member 21 so that the respective plug heads 32 can can lie therein. The first lid member 11 is then secured onto the second lid member 21 by threading the female thread 15 of the first lid member 11 onto the male thread 25 of the second lid member 21. Each lid member is secured so that the respective ring flanges, 16 and 26, are (preferably) touching and their respective flange holes, 18 and 28, are alligned. A pad lock 34, or other similar device, is then secured through the alligned flange holds, 18 and 28, and locked down. The width of the plug heads 32 being larger that the width of the respective slots 29 secures the plug heads from removal from the plug lock out apparatus 10 and potential use until the pad lock 34 is removed and the lid members, 11 and 21, disengaged.

It is intended that the description of the preferred embodiment of this invention is illustrative only. Other embodiments of the invention that are within the scope and concept of this invention are herein included within this application.

What is claimed is:

1. A plug lock out appratus for securing electrical cord-plug head combinations comprising, in combination;

a first lid member having an close-ended top and an open-ended bottom, and an inside having a female threaded portion, said bottom comprising an annular ring flange having a hole therethrough;

a second lid member having an open-ended top and a close-ended bottom, and an exterior having a male threaded portion for matable engagement with the said female threaded portion of the first lid member, and an annular ring member segregated by a plurality of elongated slots for housing the said cord-plug head combinations wherein the said annular ring member has a hole therethrough; and, means for securing said first lid member and said second lid member together.

2. In the plug lock out apparatus of claim 1, said securing means comprises the matable engagement of the respective female and male threaded portions so that allignment of the annular ring flange holes of said first and second lid member occurs.

3. In the plug lock out apparatus of claim 2, said securing means further comprises the application and lock down of a pad lock through said respective alligned annular ring flange holes.

4. In the plug lock out apparatus of claim 1, said slots numbering four.

5. In the plug lock out apparatus of claim 1, said slots comprising an elongated "U" shape.

6. In the plug lock out apparatus of claim 1, said apparatus is made from plastic.

7. In the plug lock out apparatus of claim 1, said apparatus comprises a cylindrical shape.

* * * * *